US011178901B2

(12) United States Patent
Mueller

(10) Patent No.: US 11,178,901 B2
(45) Date of Patent: Nov. 23, 2021

(54) SUCTION BELT CONVEYOR AND ROD-FORMING MACHINE OF THE TOBACCO PROCESSING INDUSTRY, AND USE AND METHOD FOR MEASURING MATERIAL PROPERTIES OF A MATERIAL ROD OF THE TOBACCO PROCESSING INDUSTRY

(71) Applicant: HAUNI MASCHINENBAU GMBH, Hamburg (DE)

(72) Inventor: Johannes Mueller, Hamburg (DE)

(73) Assignee: HAUNI MASCHINENBAU GMBH, Hamburg (DE)

( * ) Notice: Subject to any disclaimer, the term of this patent is extended or adjusted under 35 U.S.C. 154(b) by 932 days.

(21) Appl. No.: 15/726,926

(22) Filed: Oct. 6, 2017

(65) Prior Publication Data

US 2018/0027868 A1 Feb. 1, 2018

Related U.S. Application Data

(63) Continuation of application No. PCT/EP2016/057302, filed on Apr. 4, 2016.

(30) Foreign Application Priority Data

Apr. 9, 2015 (DE) ..... 10 2015 105 353.5

(51) Int. Cl.
*A24C 5/18* (2006.01)
*A24C 5/34* (2006.01)

(52) U.S. Cl.
CPC ..... *A24C 5/1857* (2013.01); *A24C 5/18* (2013.01); *A24C 5/3412* (2013.01)

(58) Field of Classification Search
None
See application file for complete search history.

(56) References Cited

U.S. PATENT DOCUMENTS 4,474,190 A 10/1984 Brand
4,638,817 A 1/1987 Okumoto
(Continued)

FOREIGN PATENT DOCUMENTS

CN 1052150 5/2000
CN 101088008 12/2007
(Continued)

OTHER PUBLICATIONS

Andrzej W. Kraszewski, "Microwave Aquametry—Needs and Perspectives", IEEE Transactions on Microwave Theory and Techniques, vol. 39, No. 5, May 1991, pp. 828-835.*
(Continued)

*Primary Examiner* — Michael H. Wilson
*Assistant Examiner* — Dionne W. Mayes
(74) *Attorney, Agent, or Firm* — Greenblum & Bernstein, P.L.C.

(57) ABSTRACT

Suction belt conveyor of a rod-forming machine of the tobacco processing industry for conveying materials, in particular tobacco, a rod-forming machine of the tobacco processing industry and use of the rod-forming machine and a method for measuring material properties of a material rod of the tobacco processing industry. The suction belt conveyor includes at least one rod guiding channel, which is open at the bottom and which is delimited by two lateral channel sides and a suction belt along a conveying path. At least one electromagnetic measuring device is integrated in the channel sides of the suction belt conveyor at at least one position along the conveying path in order to determine properties of the conveyed material.

16 Claims, 9 Drawing Sheets

(56) References Cited

U.S. PATENT DOCUMENTS

| | | | | | |
|---|---|---|---|---|---|
| 4,771,794 | A | | 9/1988 | Gaisser et al. | |
| 4,805,641 | A | * | 2/1989 | Radzio et al. | A24C 5/3412 131/280 |
| 4,875,494 | A | * | 10/1989 | Siems | A24C 5/1871 131/84.1 |
| 4,878,506 | A | | 11/1989 | Pinck et al. | |
| 5,736,864 | A | * | 4/1998 | Moller | A24C 5/3412 324/633 |
| 5,797,406 | A | * | 8/1998 | Dawson | G01N 23/083 131/281 |
| 2002/0144699 | A1 | | 10/2002 | Lorenzen | |
| 2005/0179443 | A1 | * | 8/2005 | Peters et al. | D01G 31/006 324/636 |

FOREIGN PATENT DOCUMENTS

| | | |
|---|---|---|
| CN | 104287086 | 1/2015 |
| DE | 32 07 124 | 9/1982 |
| DE | 36 24 236 | 2/1987 |
| DE | 37 25 364 | 9/1989 |
| DE | 198 25 592 | 12/1999 |
| DE | 695 15 482 | 11/2000 |
| DE | 10 2011 082 625 | 3/2013 |
| DE | 10 2013 213 936 | 1/2015 |
| EP | 0160800 | 11/1985 |
| EP | 2848133 | 3/2015 |
| JP | 10-500488 | 1/1998 |
| JP | 10-325813 | 12/1998 |
| JP | 11-346747 | 12/1999 |
| JP | 2002-340817 | 11/2002 |
| JP | 2015-19664 | 2/2015 |

OTHER PUBLICATIONS

China Office Action conducted in counterpart China Appln. No. 201380020944.2 (dated Aug. 2, 2019) (w/ English translation).

China Search Report conducted in counterpart China Appln. No. 201380020944.2 (dated Jul. 23, 2019).

Folgueras et al., "Dielectric Properties of Microwave Absorbing Sheets Produced with Silicone and Polyaniline", *Materials Research*, 13(2), 2010, pp. 197-201 (Revised: Mar. 29, 2010).

European Action conducted in counterpart European Appln. No. 16713474.1-1006 (dated May 3, 2018).

Japan Office Action conducted in counterpart Japan Appln. No. 2017-552801 (dated Jun. 24, 2020).

China Search Report & Office Action conducted in counterpart China Appln. No. 201680020944.2 (dated Feb. 20, 2021) (w/ translation).

* cited by examiner

SUCTION BELT CONVEYOR AND ROD-FORMING MACHINE OF THE TOBACCO PROCESSING INDUSTRY, AND USE AND METHOD FOR MEASURING MATERIAL PROPERTIES OF A MATERIAL ROD OF THE TOBACCO PROCESSING INDUSTRY

CROSS-REFERENCE TO RELATED APPLICATIONS

The present application is a Continuation of international Application No. PCT/EP2016/057302 filed Apr. 4, 2016 and claims priority under 35 U.S.C. § 119(a) and 365 of German Patent Application No. 10 2015 105 353.5 filed Apr. 9, 2015. The disclosure of International Application No. PCT/EP2016/057302 is expressly incorporated by reference herein in its entirety.

BACKGROUND

1. Field of the Invention

Embodiments of the invention relate to a suction belt conveyor of a rod-forming machine of the tobacco processing industry for conveying materials, in particular tobacco, a rod-forming machine of the tobacco processing industry and a use of the machine, and a method for measuring material properties of a material rod of the tobacco processing industry. The suction belt conveyor includes at least one rod guiding channel, which is open at the bottom and which is delimited by two lateral channel sides, and a suction belt along a conveying path.

2. Discussion of Background Information

As noted above, embodiments of the invention generally relate to the field of producing rods of materials in the tobacco processing industry, in particular the production of a tobacco rod. To ensure consistently high material quality, normally the rod material quality, including properties such as quantity, density, moisture, etc. of the material, is monitored with the assistance of various measuring apparatuses. For this, various measuring methods are used such as optical measuring methods, HF measuring methods, microwave measuring methods, or measuring methods using β-emitters.

With tobacco rods, it is known to provide measuring apparatuses for determining the material properties at the location where the tobacco strand is already wrapped by cigarette paper. One reason for this is that the tobacco strand is relatively easy to reach with a measuring device at that location. Another reason is that the tobacco strand then already has its final shape. The disadvantage of this known measuring method is that the influence of the paper must always also be taken into account in the arrangement of the measuring devices at this position.

SUMMARY

Embodiments of the present invention provide an alternative to the known procedure and apparatus to measure material properties of a material rod in the tobacco processing industry.

Accordingly, a suction belt conveyor of a rod-forming machine of the tobacco processing industry for conveying material, in particular tobacco, includes at least one rod guiding channel which is open at the bottom and which is delimited by two lateral channel sides and a suction belt along a conveying path, which is developed in that at least one electromagnetic measuring device is integrated in the channel sides of the suction belt conveyor at at least one position along the conveying path.

Embodiments of the invention provide unique measuring of the material, in particular tobacco material, in a very early stage, i.e., in the suction belt conveyor, in which the material is not yet been wrapped by wrapping material such as wrapping paper. Suction belt conveyors in rod-forming machines of the tobacco processing industry have a suction belt which is perforated, and a vacuum, or suction air, is applied from above. In a sprinkling region, tobacco material or other material is sprinkled intermittently from below in a stream of air onto the suction belt so that a layer of the loose material collects, or builds up on the bottom side of the suction belt and is held on the suction belt by the vacuum applied above. This suction belt moves through a guide channel with lateral channel sides so that a fixed cross-section is defined for the sprinkled material. At the discharge of the suction belt conveyor, the tobacco material passes into a formatting device in which it is wrapped with a wrapping material such as a paper or aluminum foil and formed into a rod with a round or oval cross-section.

The suction belt conveyor is a comparatively compact and solid unit. An example of a corresponding suction belt conveyor is known from DE 10 2011 082 625 A1 of the applicant, the disclosure of which is expressly incorporated by reference herein in its entirety. The suction belt is a wearing part that is exchanged approximately each shift. For this reason, the rod guiding channel is open at the bottom.

The advantage of already measuring in the rod guiding channel of the suction belt conveyor is that material properties can already be measured at an early time without interfering influences. Material properties can for example be the measurement of the density, or respectively the weight of the tobacco. Early determination of the density as proposed offers the advantage that deviations from the given values can be quickly recognized, and an immediate regulation for example of the tobacco delivery can accordingly be performed, which can advantageously reduce waste tobacco.

Preferably, electromagnetic measuring devices are used that operate within a frequency range between 100 kHz to 15 GHz.

Particularly preferably, the electromagnetic measuring device is, however, designed as a microwave measuring device with at least one resonator cavity since microwave measuring technology offers a plurality of ways to determine the properties of materials.

Preferably, the microwave measuring device includes at least one measuring opening oriented toward the conveying path. With regard to the integration of the microwave measuring device in the channel sides and the fact that the measuring device must be designed so that the suction belt can be exchanged, the microwave measuring device must be designed as a partially open sensor. Correspondingly, a measuring opening can be provided that is enclosed from above, from the sides, or in a U-shape.

Preferably, the microwave measuring device comprises two coaxial resonators which are recessed in the two opposing channel sides, and oppose each other and in particular are flush with each other (and the guide channel). This accordingly yields a possibly symmetrical arrangement on both sides of the guide channel in the suction belt conveyor in which the guide channel itself between the two coaxial resonators is part of the resonator cavity. In this case, one coaxial resonator is excited while the opposite coaxial resonator functions as a receiver. The coaxial resonators are preferably coaxial resonators that are short-circuited at the end.

In an alternative or additional embodiment of the invention, the at least one microwave measuring device preferably has an in particular additional resonator cavity with a rectangular cross-section in each of the two opposing channel sides, which are in particular arranged flush with each other on both sides of the rod guiding channel.

Resonator cavities with a rectangular cross-section make it possible to very precisely adjust the microwave field passing through the tobacco material by selecting the wall dimensions.

Designing a resonator cavity with a rectangular cross-section would mean that the rectangular cross-section is larger or smaller in the direction of the conveying path than vertically transverse to the conveying path. The smaller of the cross-sections would have an extension less than one-half wavelength of a microwave measuring frequency. When the rectangular cross-section in the direction of the conveying path is larger than vertically transverse to the conveying path, a geometry is selected in which the electrical field in the tobacco material has a preferred component in the vertical direction (Y-direction). Such a field results in a very effective penetration of the material rod. Conversely, when the extension of the resonator cavity transverse to the rod conveying direction, i.e., vertically, is larger than in the rod conveying direction, the Z component of the electrical field, i.e., the component in the rod conveying direction, is dominant in the material. This field also effectively penetrates the material, and the measuring window along the rod conveying direction is narrower so that smaller structures can also be resolved by quick changes over time. This is at the cost of a slightly greater extension of the stray field in the rod direction.

In one advantageous development, a cover is arranged above the openings in the resonator cavities and the suction belt and is designed to reflect microwaves. In particular, a distance between the cover and suction belt is a few millimeters, in particular less than 20 mm, in particular less than 6 mm. The effect of this cover is that the microwave measuring field and stray fields are limited in a vertically upward direction, which has a positive influence on stray fields of the microwave measuring field. For example, when the distance of the cover is reduced from 18 mm to 4 mm, the maximum field strength of the stray field at a distance of 1 m can be reduced by a factor of 4 or more.

In another alternative or additional preferred design, the at least one microwave measuring device includes, especially in addition, a reverse U-shaped slotted rectangular resonator that encloses the rod guiding channel on three sides. The structural reason for this special reverse U-shaped design of a rectangular resonator is that the guide channel of the suction belt conveyor must be open at the bottom in order to allow the suction belt to be exchanged. The continuous resonator cavity extends from the side in a channel side transversely across the guide channel to the other side into the other channel side, in both channel sides, the resonator cavity opens in two slots to the guide channel, the dimensions of which are narrower in the direction of conveyance than the dimensions of the resonator cavity itself, so that the resonator cavity narrows toward the center, i.e., toward the guide channel. The quality of such a slotted rectangular resonator is very high, and the measuring field penetrates effectively into the guide channel. Since it extends directly up to the tobacco material, such a resonator has a particularly high sensitivity to fluctuations in the properties of the material rod.

With the slotted rectangular resonator, the cross-section of the resonator cavity preferably also narrows, with reference to the alignment of the rod guiding channel, from the outside toward an opening toward the channel side.

All of the previously-described microwave measuring devices that can be used according to the invention are preferably operated in transmission. A reflection measurement in which a resonator is recessed in only one channel side and the other channel side reflects is also possible and provided in the context of the invention. This applies both in the case of an open coaxial resonator as well as for resonators with a rectangular cross-section.

Microwave measuring devices radiate part of their output into the surroundings depending on their design. According to the requirements of various standards (EU: TBD, USA: TBD), the output of microwave radiation may not exceed certain threshold values. With microwave measuring devices that have an enclosed resonator, no modes can propagate in the opening in the microwave measuring device through which the rod is guided. Things are different with partially-open microwave measuring devices such as the slotted rectangular resonator. In this case, modes can propagate through the openings, which can lead to radiation that lies clearly above the threshold values to be maintained.

In the case of measurements using the transmission method, the resonators are excited by two symmetrically arranged couplings or decouplings. Different modes can be excited in principle. It is desirable to excite a mode whose electrical field runs parallel to the rod in the measuring area since it was revealed that a field oriented perpendicular to the rod excites modes in the channel side that are capable of propagation. This is the case for example with the cylindrical TM010 mode, or with its related TE110 mode in a slotted rectangular resonator.

However, given the arrangement of the coupling/decoupling, a mode orthogonal thereto is also excited. Its electrical field runs perpendicular to the rod and forms a direct connection between the coupling and decoupling. Both field distributions are excited and ultimately overlap.

The applicant has found that it is the electrical field oriented perpendicular to the rod that generates propagatable modes in the channel side and is accordingly responsible for the radiation.

To generate a field oriented parallel to the rod in the slotted rectangular resonator, the resonator therefore preferably has three coupling and decoupling antennas, of which two antennas are arranged symmetrically to both sides of the rod guiding channel, and the third antenna is arranged in a plane of symmetry of the resonator cavity above the rod guiding channel, wherein the two symmetrically arranged antennas are excited in-phase, and the middle antenna serves as a decoupling antenna, or the middle antenna is excited, and the two symmetrically arranged antennas (268, 269) serve as decoupling antennas.

The advantage offered by the symmetrical arrangement of the antennas together with the in-phase excitation of the symmetrical antennas in the two sides of the slotted rectangular resonator and a decoupling in the top area in the plane of symmetry is that no field distributions are excited that possess horizontal field components perpendicular to the rod, which can significantly reduce radiation.

The in-phase excitation is generated for example by signal division with a Wilkinson divider, while the field is to be tapped at a third gate, or respectively antenna, arranged in the middle of the plane of symmetry. Alternatively, the middle gate, or respectively the middle antenna, can be excited, and the signal can be tapped in-phase at the two symmetrical gates (antennas).

Alternatively or to further reduce radiation, one or both channel sides has, or respectively have, one or more microwave-absorbing bodies, e.g., a flat body, recessed in the channel side or channel sides in a suction belt conveying direction downstream and/or upstream from the at least one resonator cavity. These can be foam materials, rubber layers, thin films, etc. with corresponding absorption properties, such as based on silicones or polyanilines as for example disclosed in L. de Castro Folgueras et al., "Dielectric Properties of Microwave Absorbing Sheets Produced with Silicone and Polyaniline", Materials Research 2010, 13 (2), p. 197 to 201. Other materials with sufficiently large absorption properties are also suitable for this.

Preferably, power electronics and/or measuring electronics are arranged on the suction belt conveyor and thermally coupled to the suction belt conveyor. This ensures that the microwave measuring device, which has a comparatively low power requirement due to its compactness, is provided with electronics that are maintained at a basically constant temperature given the thermal coupling to the suction belt conveyor that constitutes a high thermal mass.

Alternative to a microwave measuring device, the electromagnetic measuring device can also be designed as a capacitive measuring device. Due to the rectangular dimensions of the suction belt conveyor, the capacitive measuring device can be considered a type of plate capacitor. On both sides of the channel side it is conceivable to provide dielectric cavities to which electrodes are attached in the form of metal surfaces.

Embodiments of the invention are directed to a rod-forming machine of the tobacco processing industry, in particular a tobacco rod-forming machine with an above-described suction belt conveyor according to the invention.

Likewise, embodiments are directed to using a microwave measuring device in an above-described suction belt conveyor according to the invention of a rod-forming machine in the tobacco processing industry to measure the material properties of a tobacco material sprinkled from below onto a suction belt and held with suction air on the suction belt.

Finally, embodiments of the invention are directed to a method for measuring material properties of a material rod, in particular a tobacco rod of the tobacco processing industry. The material properties of the material conveyed on a suction belt of an above-described suction belt conveyor according to the invention that is sprinkled from below and conveyed by the suction belt along a conveying path through a guide channel of the suction belt conveyor are measured along the conveying path in the guide channel via a microwave measuring device of the suction belt conveyor, or respectively in the suction belt conveyor.

It is conceivable to use the method as a broadband or resonant method. Preferably, the resonant method is used as the method since, in comparison to the broadband method which characterizes the material over a certain frequency range, the resonant method only measures the resonant frequency. It is therefore not only faster, but rather also much more precise, at least at this frequency.

Reflection measurement or transmission measurement, inter alia, are possible operating modes. Preferably, the measurement is performed as a transmission measurement in which in particular in a resonant method, measuring is always carried out at the maximum signal level, which simplifies the detection of measured values. In this context, loss measurement is also more precise and less sensitive with regard to external circuitry.

The advantages, properties and features of the rod-forming machine according to embodiments of the invention, the use of the rod-forming machine and method correspond to those of the suction belt conveyor according to the embodiments to which they refer.

Embodiments of the invention are directed to a suction belt conveyor for conveying material. The suction belt conveyor includes at least one rod guiding channel, which is open at a bottom and is delimited by two lateral channel sides and a suction belt along a conveying path; and at least one electromagnetic measuring device integrated in at least one of the lateral channel sides at at least one position along the conveying path to determine properties of the material being conveyed.

According to embodiments, the suction belt conveyor can be configured in a rod-forming machine of the tobacco processing industry for conveying tobacco.

In accordance with other embodiments, the at least one electromagnetic measuring device may include a microwave measuring device with at least one resonator cavity. The microwave measuring device can include at least one measuring opening oriented toward the conveying path. In embodiments, the microwave measuring device may include two coaxial resonators recessed in the two channel sides opposite each other. In embodiments, the at least one microwave measuring device may have a resonator cavity with a rectangular cross-section in each of the two opposing channel sides. The rectangular cross-sections and two opposing sides can be arranged flush with each other on both sides of the rod guiding channel. In embodiments, the at least one microwave measuring device can include a reverse U-shaped slotted rectangular resonator that encloses the rod guiding channel on three sides. Further, the slotted rectangular resonator can include three antennas, of which two antennas are arranged symmetrically to both sides of the rod guiding channel, and a third antenna is arranged in a plane of symmetry of the resonator cavity above the rod guiding channel. Moreover, the two symmetrically arranged antennas are excited in-phase, and the third antenna serves as a decoupling antenna, or the third antenna is excited, and the two symmetrically arranged antennas serve as decoupling antennas.

According to further embodiments, the suction belt conveyor can include at least one microwave-absorbing body recessed in at least one of the channel sides at least one of upstream and downstream, with respect to a suction belt conveying direction, from the at least one resonator cavity.

In still other embodiments, the measuring device may include a capacitive measuring device.

According to other embodiments, at least one of power and measuring electronics can be arranged on the suction belt conveyor.

In still further embodiments, a rod-forming machine can include the above-described suction belt conveyor. Moreover, the rod-forming machine may be positionable in a tobacco rod-forming machine of the tobacco processing industry.

According to still further embodiments, a method of operating an electromagnetic measuring device in the above-described suction belt conveyor, in which the measuring device can be a microwave measuring device and the suction belt conveyor can be arranged in a rod-forming machine in the tobacco industry. The method includes holding tobacco material sprinkled from below onto a suction belt with suction air; and measuring material properties of the held tobacco material.

In further embodiments, a method for measuring material properties of a material rod includes sprinkling material for the rod onto a suction belt of a suction belt conveyor according to claim 1 from below; conveying the material via the suction belt along the conveying path through a guide channel of the suction belt conveyor; and measuring, in the guide channel and along the conveying path, material properties of the conveyed material on the suction belt with an electromagnetic measuring device of the suction belt conveyor.

In embodiments of the method, the material rod can be a tobacco rod of the tobacco processing industry.

In accordance with still yet other embodiments of the method, the electromagnetic measuring device may include comprises a microwave measuring device. The microwave measuring device can operate with a resonant method. Further, the resonant method can be performed as a transmission method.

Further features of the invention will become apparent from the description of embodiments according to the invention together with the claims and the included drawings. Embodiments according to the invention can fulfill individual characteristics or a combination of several characteristics.

BRIEF DESCRIPTION OF THE DRAWINGS

The invention is described below, without restricting the general idea of the invention, based on exemplary embodiments in reference to the drawings, wherein we expressly refer to the drawings with regard to the disclosure of all details according to the invention that are not explained in greater detail in the text. In the following.

In the drawings, the same or similar types of elements and/or parts are provided with the same reference numbers so that a re-introduction is omitted.

DETAILED DESCRIPTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
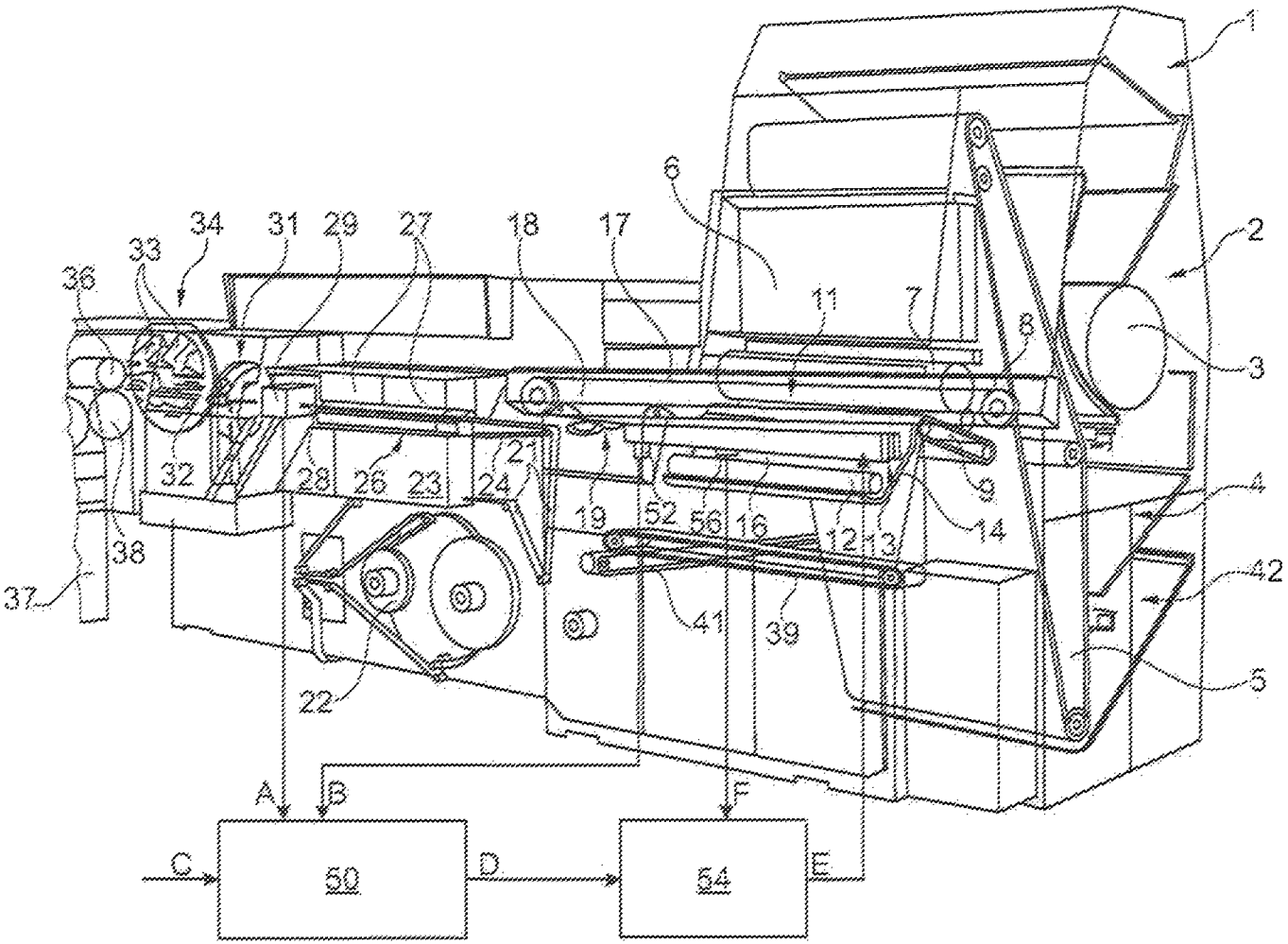
Fig. 1 Prior art
FIG. 1 shows a schematic overview of a cigarette rod-forming machine.

FIG. 1 schematically portrays a known cigarette rod-forming machine according to DE 10 2011 082 625 A1, the design and operation of which will be explained below.

A predistributor 2 is loaded in portions with tobacco fibers (not shown in the figures) from a sluice 1. A takeout roller 3 in the predistributor 2 supplies a tank 4 with tobacco fibers from the predistributor 2. A steep-angle conveyor 5 removes the tobacco fibers from the tank 4 and feeds a bulking chute 6. From the bulking chute 6, a pin roller 7 removes a substantially uniform stream of tobacco fibers, which is beaten out of the pins of the pin roller 7 by a picker roller 8, and flung onto an apron 9 that circulates at a constant speed. A tobacco carpet forms on the apron 9 from the stream of tobacco. The tobacco carpet is flung into a sieving device 11 which substantially consists of an air curtain that lets larger or respectively, heavy tobacco parts pass by, whereas all other tobacco particles are dropped by the air into a funnel 14 formed by a pin roller 12 and a wall 13.

The tobacco fibers are conveyed out of the funnel 14 by the pin roller 12 to the suction belt conveyor 160 in a rod guiding channel 16 and are flung there against a lower run, forming the floor of the rod guiding channel 16, of an air-permeable continuously circulating suction belt 17 with a vacuum applied to the rear, onto which a rod-shaped tobacco fiber cake consisting of the tobacco fibers is sprinkled that is accordingly held on the lower run of the suction belt 17 with the assistance of air drawn into a vacuum chamber 18. Via the circulating suction belt 17, the tobacco fiber cake sprinkled, or respectively collected therein is conveyed as a suspended rod along the rod guiding channel 16. The bottom run of this suction belt 17 extends through the rod guiding channel 16 from its beginning where the rod-forming zone is located, in the depicted exemplary embodiment up to an equalizer or trimmer 19 to remove excess tobacco fibers.

Then the tobacco fiber rod formed in this manner is placed on a strip of cigarette paper 21 running in sync. The strip of cigarette paper 21 is drawn by a bobbin 22, guided through a print unit 23, and placed on a driven garniture tape 24. The garniture tape 24 transports the tobacco rod together with the strip of cigarette paper 21 through a format 26 in which the strip of cigarette paper 21 is folded around the tobacco rod so that only a narrow edge stands up which is glued in a known manner by a glue mechanism (not shown). Then the adhesive seam formed in this manner is closed and dried by a tandem seam sealer 27.

The cigarette rod 28 formed in this manner passes through a measuring unit 29 and is cut by a knife mechanism 31 into double-length cigarettes 32. The double-length cigarettes 32 are transferred by a transfer apparatus 34 having controlled arms into a take-over drum 36 of a filter assembler 37, on whose cutting drum 38 they are divided into individual cigarettes using a circular knife.

Conveyor belts 39, 41 convey excess tobacco fibers trimmed by the trimmer 19 into a container 42 disposed beneath the tank 4, from which the excess tobacco fibers are removed as returned tobacco by the steep-angle conveyor 5.

Figure 2B:
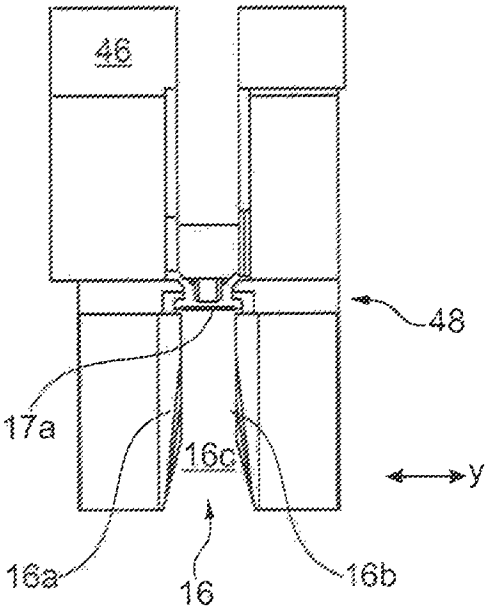
Fig. 2B Prior Art
FIGS. 2A and 2B schematically show a perspective detail drawing and a cross-sectional view, respectively, of a rod guiding channel provided in the known cigarette rod-forming machine of FIG. 1.
Figure 2A:
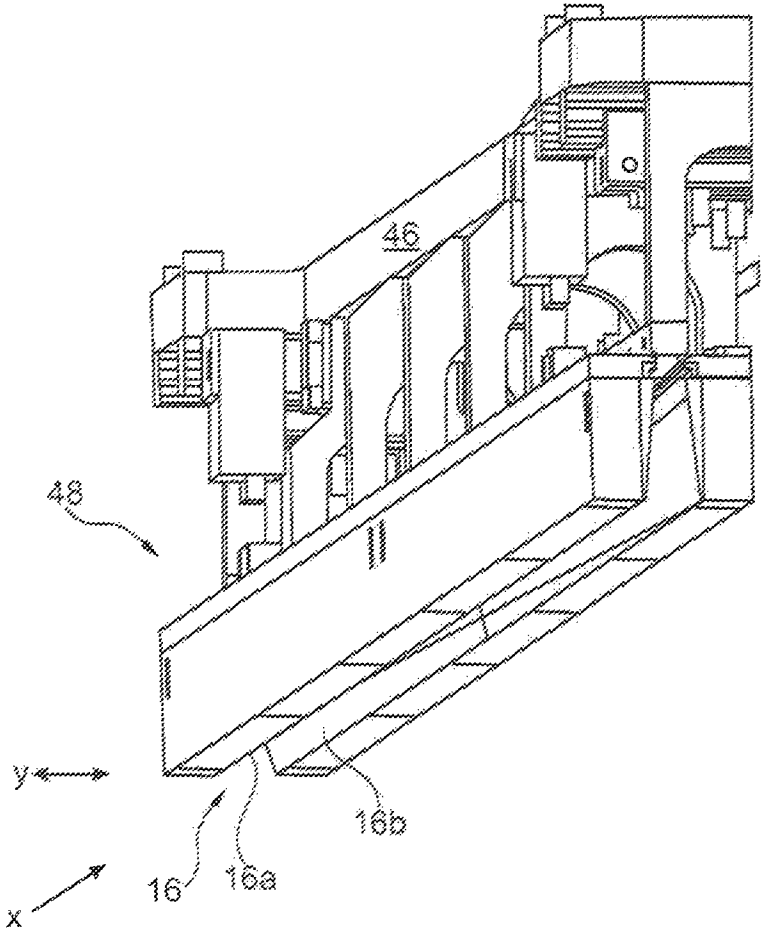
Fig. 2A Prior Art

FIGS. 2A and 2B show an assembly or unit that includes the known rod guiding channel 16 from DE 10 2011 082 625 A1.

The assembly, which includes the rod guiding channel 16, has a frame 46 through which this assembly is arranged in the machine depicted in FIG. 1. The rod guiding channel 16 is open at the bottom and has two lateral sides 16*a*, 16*b* at a distance from each other. Moreover, FIG. 2B shows a schematic cross-section of the bottom run 17*a* of continuously circulating suction belt 17 (see FIG. 1), which forms the floor (lying at the top) of the rod guiding channel 16. The cavity 16*c* and hence also the cross-section of the rod guiding channel 16 is delimited by the two side channel sides 16*a*, 16*b* and the bottom run 17*a* for of the suction belt 17. The distance between the two side channel sides 16*a*, 16*b* of the rod guiding channel 16 determines the width of the rod-shaped tobacco cake sprinkled in the cavity 16*c* of the rod guiding channel 16.

In the depicted example, at least one of the two lateral sides 16*a*, 16*b* can be adjusted transversely to the rod conveying direction identified by arrow X in FIG. 2A, i.e., lateral side 16*a* and/or 16*b* can be adjusted in the direction of double arrow Y in FIGS. 2A, 2B. Given the adjustability of at least one of the two lateral sides 16*a*, 16*b*, their distance from each other and hence the clearance width of the cavity 16*c* of the rod guiding channel 16 can be changed, which also brings about a corresponding change in the width of the rod-shaped tobacco cake sprinkled in the cavity 16*c* of the rod guiding channel 16. With the given cross-sectional area of the rod-shaped tobacco cake sprinkled in the cavity 16*c* of the rod guiding channel 16, changing the width also has an influence on the deposited height.

The lateral sides 16*a*, 16*b* are adjusted using a drive device 48 that is actuated by a subsequent regulation in which the distance between the two channel sides 16*a*, 16*b*, or respectively the clearance width of the cavity 16*c* of the rod guiding channel 16, forms the manipulated variable.

The measuring unit 29 above is preferably designed to detect the cross-section, the ovality, or respectively roundness and/or the density of the cigarette rod 28, and/or the weight of the cigarettes 32, and/or the weight of the cigarette rod 28 per unit length, and/or the degree to which the cigarette rod 28 is and/or the cigarettes 32 are filled with fiber, and is designed to emit a corresponding output signal A. The output signal A is transmitted to a controller 50. As FIG. 1 schematically reveals, a distance sensor 52 is provided on the rod guiding channel 16 that detects the deposited height of the rod-shaped tobacco cake in the rod guiding channel 16 and transmits a corresponding output signal B to the controller 50. The distance sensor 52 is arranged upstream from the trimmer 19.

Another distance sensor 56 is provided on the rod guiding channel 16 with the assistance of which the respective actual value for the clearance distance between the two lateral sides 16*a*, 16*b* of the rod guiding channel 16, and accordingly the width of its cavity 16*c*, are detected, and a corresponding signal F is transmitted to the adjusting device 54. The controller 50 processes a target value signal C as another input variable, by which a corresponding target value is specified for the parameter(s) to be controlled. These three signals A, B and C are processed in the controller 50 that, as a result, produces an output signal D in order to correspondingly actuate a downstream adjusting device 54.

Figure 3A:
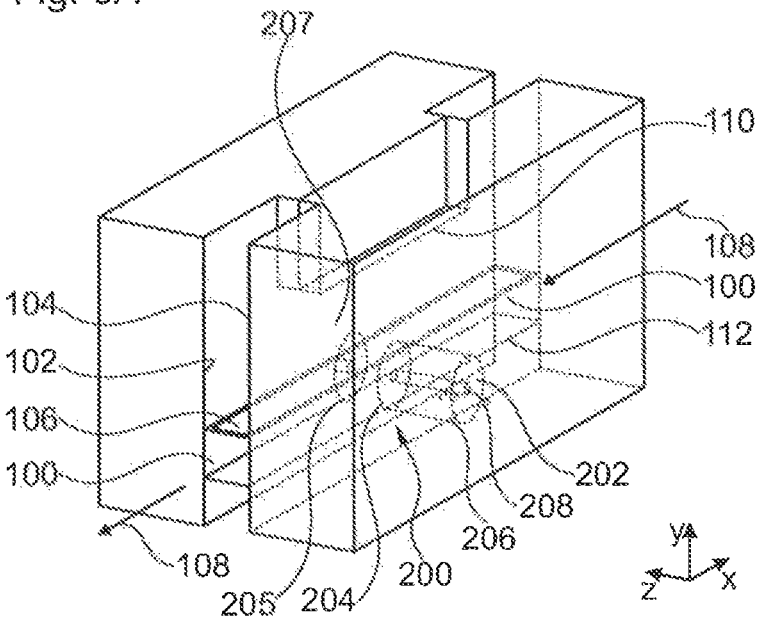
FIGS. 3A-3C show a schematic representation of a first embodiment of a suction belt conveyor with a microwave measuring device having a field distribution and emission characteristic.
Figure 3B:
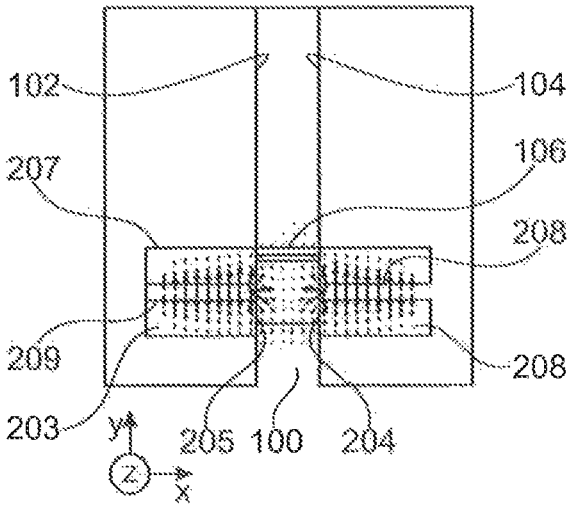

FIGS. 3A and 3B schematically show a section of a first exemplary embodiment according to the invention of a suction belt conveyor with coaxial resonators 206, 207 recessed in the channel sides 102, 104. These can be, but do not have to be, designed like the channel sides 16*a*, 16*b* from FIGS. 2A and 2B. Preferably, the channel sides are designed solid outside of the microwave measuring devices.

A section of a rod guiding channel 100 is shown, in which the rod conveying direction 108, or the conveying path 108, is indicated with an arrow. Between the channel sides 102, 104, a suction belt 106 extends that is moved in the rod-conveying direction 108 and is sprinkled with material up to a fill height 112, which is also a till depth since sprinkling is from below. A cover 110 is arranged above the suction belt 106 and limits the emissions at the top from a microwave measuring field from the coaxial resonators 206, 207. In the schematic depiction, the rear channel side 102 is depicted solid, and the front channel side 104 is depicted semi-transparent. The cover 110 is actually a single piece and does not consist of two halves as depicted, merely for the sake of clarity, in the schematic representation in FIG. 3A.

The coaxial resonators 206, 207 of the microwave measuring device 200 each have a resonator cavity 202, 203 as can be easily seen in FIG. 3B. A coaxial antenna 208, 209 is centrally arranged in each resonator cavity 202, 203. The resonator cavities 202, 203 open toward the guide channel 100 with openings 204, 205 so that an electromagnetic microwave field indicated with arrows penetrates the guide channel 100.

Figure 3C:
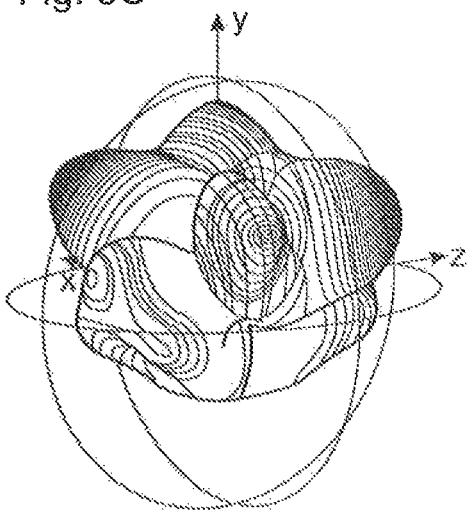

A coordinate system is shown both in FIG. 3A and FIG. 3B in which the Z direction corresponds with the conveying path 108, the X direction, which is perpendicular to the Z axis, is in a horizontal direction, and the Y direction, which is perpendicular to the Z axis, is in a vertical direction. Both coaxial resonators 206, 207 are preferably λ/4 coaxial resonators short-circuited at the end. The greatest field strength occurs at the interface of the open end of the respective coaxial resonator 206, 207 and attenuates toward the center of the guide channel 100. The coaxial resonators 206, 207 have an emission characteristic maxima that are particularly pronounced in the Z and X direction, as shown in FIG. 3C.

Figure 4A:
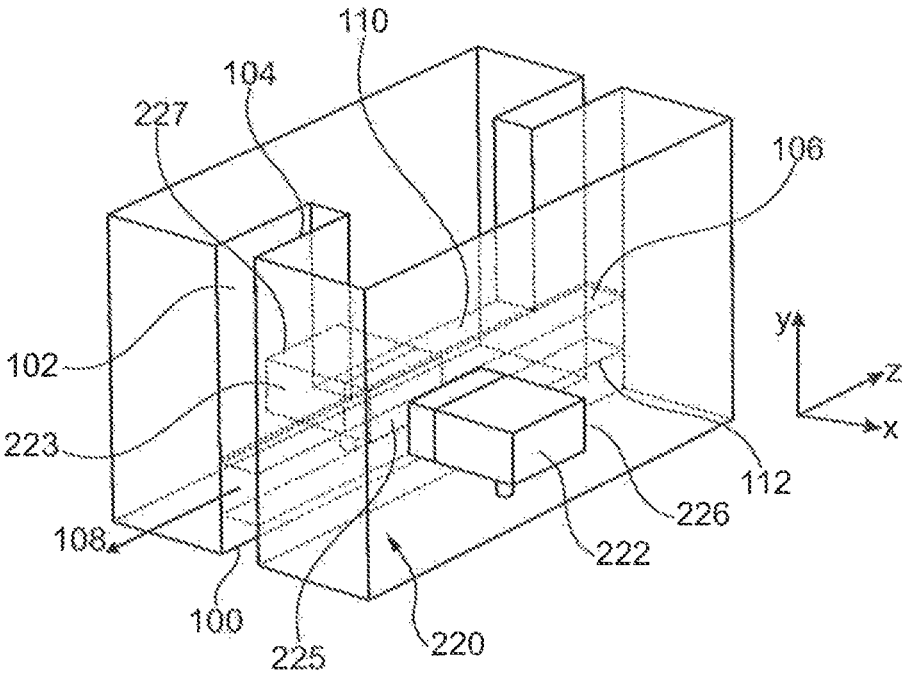
FIGS. 4A-4C show a schematic representation of another embodiment of a suction belt conveyor with a microwave measuring device, field characteristic and emission characteristic.
Figure 4B:
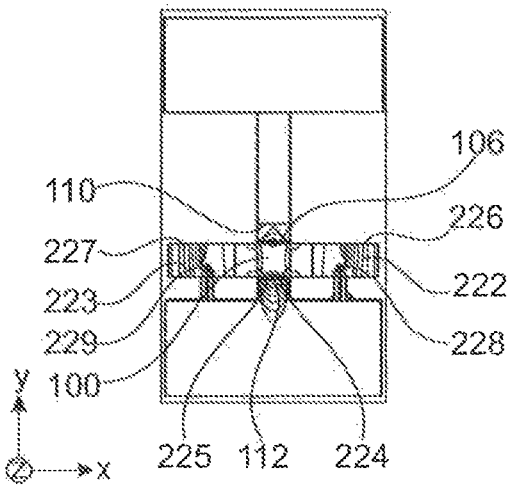

FIGS. 4A and 4B schematically portray an alternative exemplary embodiment according to the invention. In contrast to the microwave measuring device 200 from FIG. 3, the microwave measuring device 220 in FIGS. 4A and 4B is a symmetrical assembly with two resonator cavities 222, 223 that have a rectangular cross-section, each of which opens to the guide channel 100 with an opening 224, 225. The extension of the resonator cavities 222, 223 in the direction of the conveying path 108 is much larger than transverse thereto so that an electrical field with primarily a Y component ($E_y$) is formed. The corresponding antennas 228, 229 penetrate the resonator cavities 222, 223 in a vertical direction from below to generate the microwave field with a dominant Y component.

The field strength distribution of the $E_y$ field component is portrayed in FIG. 4B. The penetration of the guide channel 100 is evidently effective. The vertical dimension of the resonator cavities 222, 223 is much less than one-half wavelength of the wavelength of the used microwave measuring field of between 4 and 6 GHz. The dimension in the rod direction is greater than one-half wavelength so that a mode, its field component in the Y direction, can propagate vertically relative to the rod direction 108 (Z direction).

Figure 4C:
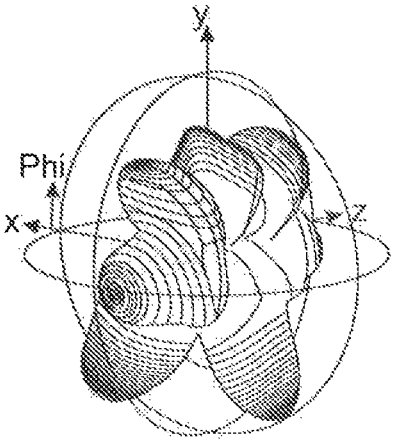

The short distance of the cover 110 to the suction belt 106 is also easily discernible in FIG. 4B. As the distance of the cover 110 to the suction belt 106 increases, the resonance frequencies of the different modes that are excited approach each other, which has advantages in terms of measurement. At the same time, however, undesirable emissions increase, so that a smaller cover distance is desirable for the emissions. An exemplary field distribution and emission characteristic in the guide channel is depicted in FIG. 4C.

Figure 5A:
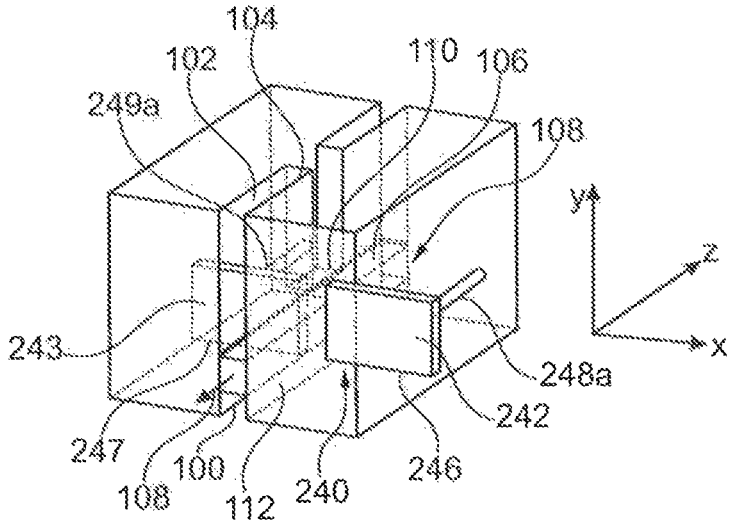
FIGS. 5A-5C show another alternative embodiment in a schematic representation of a suction belt conveyor with a microwave measuring device, field characteristic and emission characteristic.
Figure 5B:
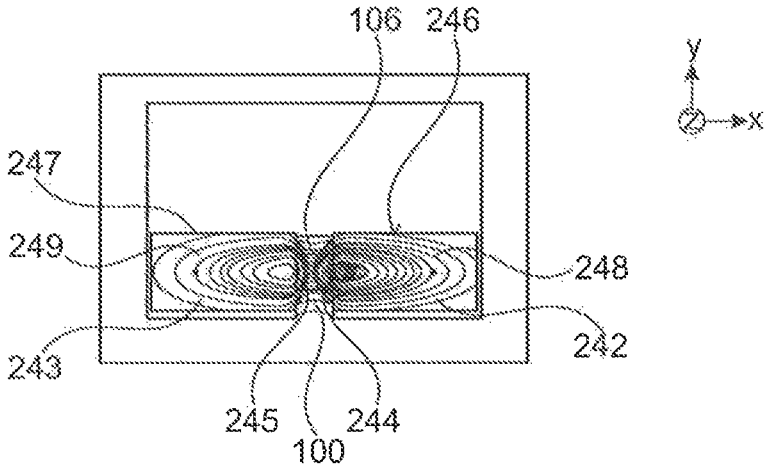

FIGS. 5A and 5B schematically portray another exemplary embodiment of a suction belt conveyor according to the invention with a microwave measuring device 240. As shown in a perspective view in FIG. 5A, there are two rectangular resonators 246, 247 recessed in the channel sides 102, 104 with rectangular resonator cavities 242, 243 which, like in the previous exemplary embodiments, are flush with each other and penetrate the guide channel 100 at the level of the material sprinkled onto the suction belt 106. The rectangular resonator cavities 242, 243 have a short extension of less than one-half wavelength of the microwave measuring field in the rod direction 108, and more than one-half wavelength transverse thereto in a vertical (Y) direction.

Figure 5C:
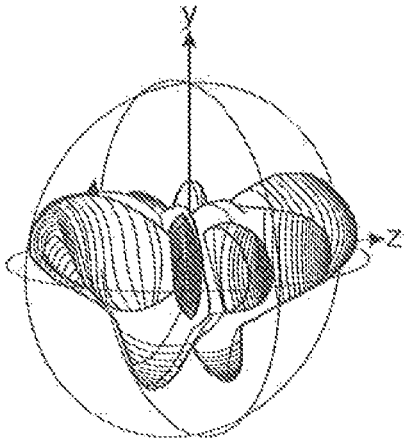

As can be seen in FIG. 5B, the antennas 248, 249 with their antenna cables 248*a*, 249*a* are arranged symmetrically on both sides and extend in the rod direction 108, i.e., the Z direction, into the resonator cavities 242, 243. A field with electrical field lines is excited in the Z direction (E) as the main component. At the locations of the openings 244, 245 in the guide channel 100, this penetrates the material in the guide channel 100 and attenuates toward the center. Overall, the electrical field effectively penetrates the material, and the measuring window in the Z direction is narrower than with the $E_y$ resonator in FIGS. 4A-4C. However, the X component of the electrical field propagates into the channel side and, as can be seen in the emission characteristic in FIG. 5C, produces scattered radiation in the Z direction.

FIGS. 6A-6D schematically portrays another exemplary embodiment with a microwave measuring device 260 with a slotted rectangular resonator 266 that extends in a reverse U-shape around the guide channel 100, or respectively the material, below the suction belt 106 and is open at the bottom to allow an exchange of the suction belt. In the center, slotted openings 265 are discernible in FIG. 6A, which define a very narrow measuring window in the Z direction. A perspective view of a cross-section of the resonator cavity 262 of the slotted rectangular resonator 266 is schematically portrayed in FIG. 6B. Toward the center, i.e., toward the guide channel 100 with the material, the cross-section of the resonator cavity 262 narrows in the Z direction via a collar 272. The couplings 268*a*, 269*a* of two antennas 268, 269 are depicted that extend in the Z direction into the resonator cavity 262. The microwave field in the resonator forms within the entire U-shaped resonator.

Figure 6A:
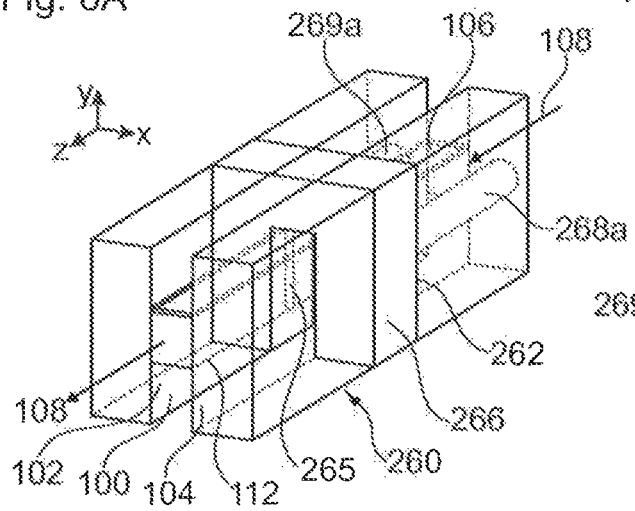
FIGS. 6A-6E show a schematic representation of another alternative embodiment of a suction belt conveyor with a slotted rectangular conveyor with detail drawings, a field distribution and emission characteristic.
Figure 6B:
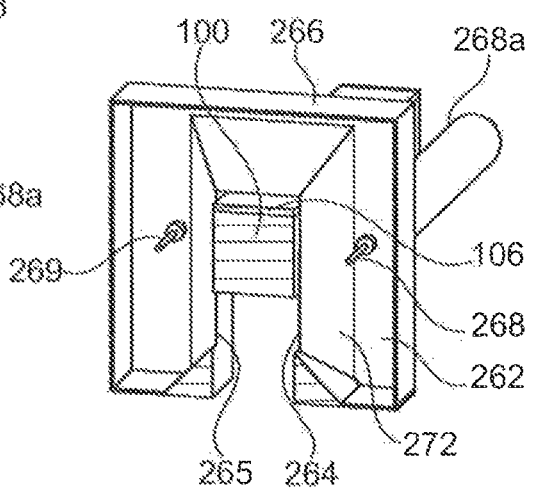
Figure 6C:
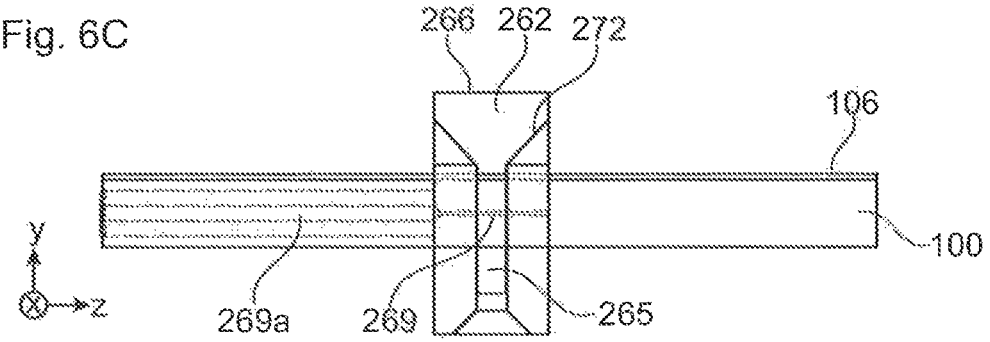

FIG. 6C shows a cross-section in the Y-Z plane through the guide channel 100 and the slotted rectangular resonator 266 in which the embodiment of the collar 272 is easily discernible as well as the arrangement of the antenna 269 extending into the resonator cavity 266 in the Z direction, and the arrangement of the antenna cable 269 outside thereof.

Figure 6D:
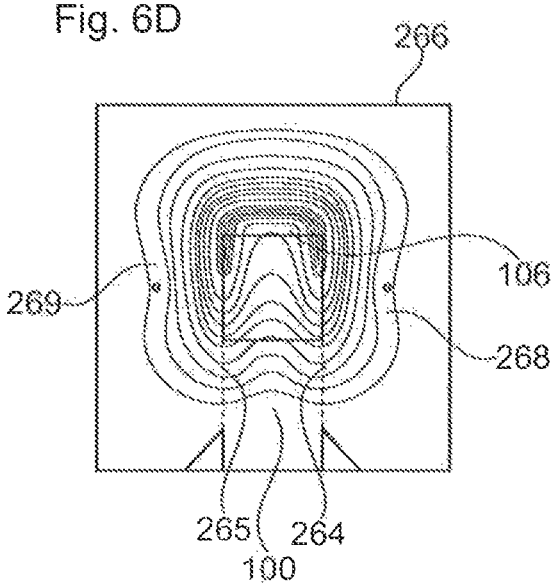

FIG. 6D shows the field distribution of the electrical field strength in a front view with the cross-sectional plane in the center of the slot 265 for the resonator 266 according to FIG. 6A-6C. In the shown structure, the electrical field decreases downward and toward the middle but, however, has the advantage that it directly borders the material, and there are no construction-related distances with the exception of windows transparent to microwaves that prevent the resonator cavity 262 from becoming soiled. The sensor has the greatest sensitivity of all microwave measuring devices described up to this point.

Figure 6E:
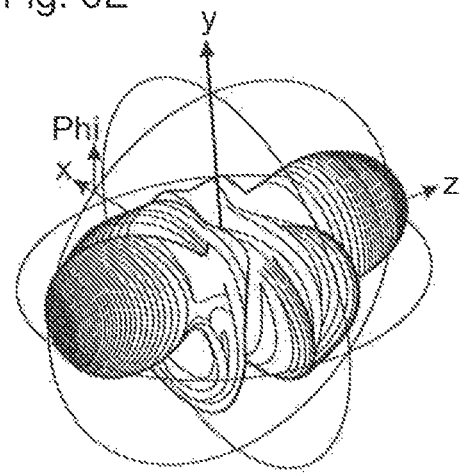

The emissions shown in FIG. 6E are the greatest in the Z direction and, in comparison to the other exemplary embodiments, have a maximum emission.

Figure 7A:
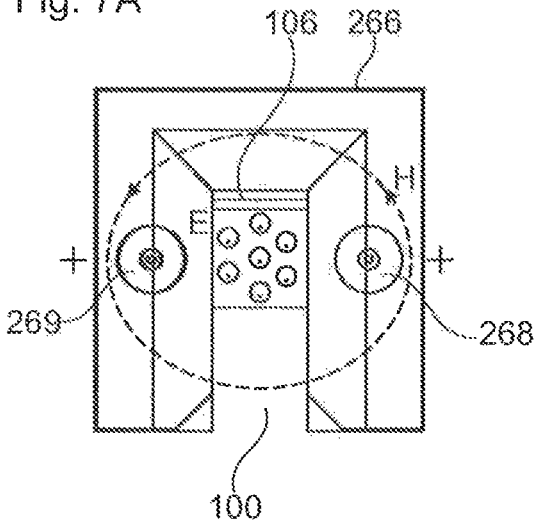
FIGS. 7A-7C show schematic representations of the actuation of a corresponding slotted rectangular resonator with emission characteristics.
Figure 7B:
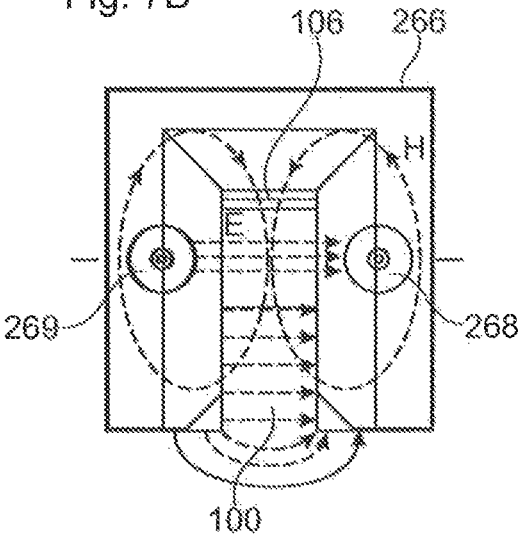
Figure 7C:
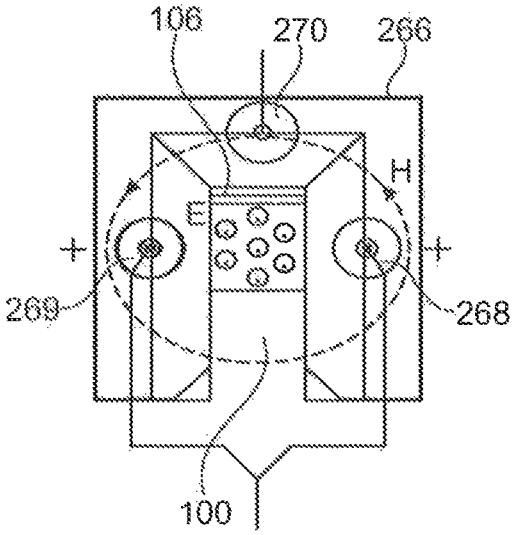

Different configurations of the actuation of the slotted rectangular resonator 266 are shown in FIG. 7A-7C.

With a symmetrical resonator such as the slotted rectangular resonator 266, two propagatable modes are excited: the "common" mode in which the electrical field lines (E) in the rod run (primarily) parallel thereto and the magnetic field (H) encloses both antennas 268, 269; and the "differential" mode in which the electrical field lines run (primarily) orthogonally to the rod between the antennas 268, 269. The actual field distribution is ultimately an overlap of the two modes. Common, or respectively differential mode can be excited separate from each other when the coupling and decoupling antenna (coupling element) are excited in common mode (FIG. 7A), or respectively differential mode (FIG. 7B). It was revealed that differential mode is the mode that excites so-called plate modes in the channel side that can propagate and radiate there as shown in FIG. 7B.

FIG. 7C shows an exemplary embodiment according to the invention in which the insight about in-phase excitation is advantageously implemented to reduce emissions.

According to the depicted exemplary embodiment, the two symmetrically arranged antennas 268, 269 are excited in-phase (for example, by a single signal division with a Wilkinson divider), and effectively represent an electrode (coupling or decoupling). The other electrode 270 is inserted into the plane of symmetry as depicted in FIG. 7C. Given this arrangement, no field distributions are excited that possess horizontal field components perpendicular to the rod. In this way, an emission of the microwave output into the surroundings can be advantageously at least partially suppressed.

An arrangement without the second electrode in the plane of symmetry is also conceivable. In this case, the resonator is operated with reflection.

The dimensions of the slotted rectangular resonator 266 move within a range of about 50 to 100 mm in the Z direction, about 50 to 100 mm in the Y direction, and about 70 mm in the X direction. Other dimensions are of course also possible and realizable according to the invention.

Figure 8A:
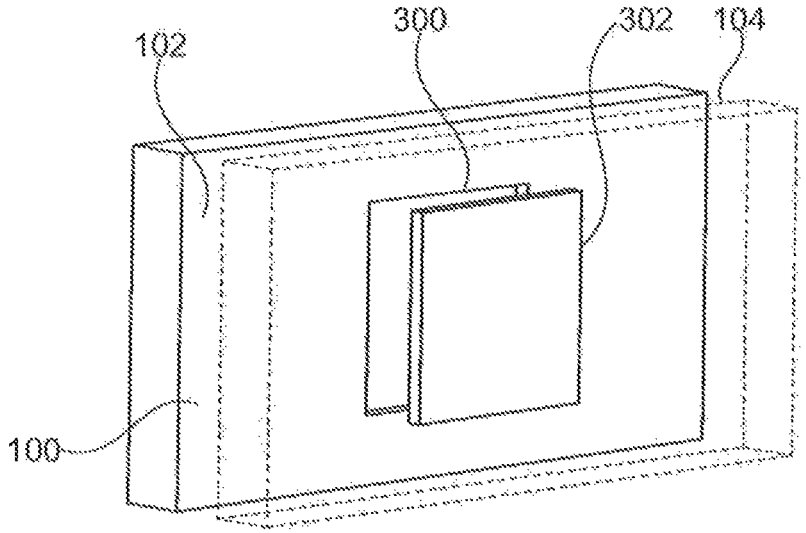
FIGS. 8A and 8B show schematic representations of absorption elements for the channel sides of a suction belt conveyor according to the invention.
Figure 8B:
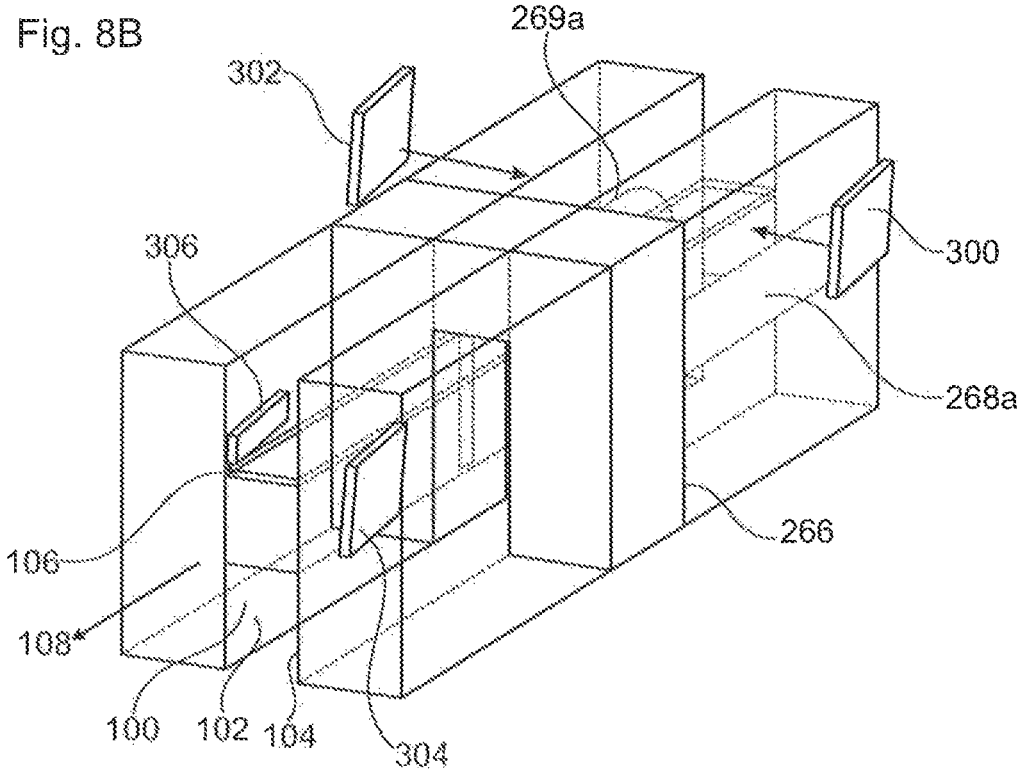

One way to reduce emissions, in particular by plate modes in the channel sides, is schematically portrayed in FIGS. 8A and 8B, which show schematic sectional representations of the guide channel 100 with channel sides 102, 104 in which are recessed elements 300, 302 that absorb opposite from each other and include a material with a complex dielectric constant such as a microwave-absorbing rubber material, foam, etc. These draw power from the emitted microwave field to reduce the emissions to the outside. FIG. 8B shows the arrangement of such absorbing elements 300, 302, 304, 306 upstream and downstream from the slotted rectangular resonator 266 in the channel sides 102, 104. The corresponding absorbing elements 300 to 306 are, for example, to be inserted in cavities in the channel sides 102, 104 created therefor along the direction of propagation. The achieved damping increases with the size and the layer thickness of the absorbing material. In the case of two side-by-side 3×3 centimeter layers, a basic mode of the TEM plate mode can be dampened by more than 10 dB in the direction of propagation.

Figure 9:
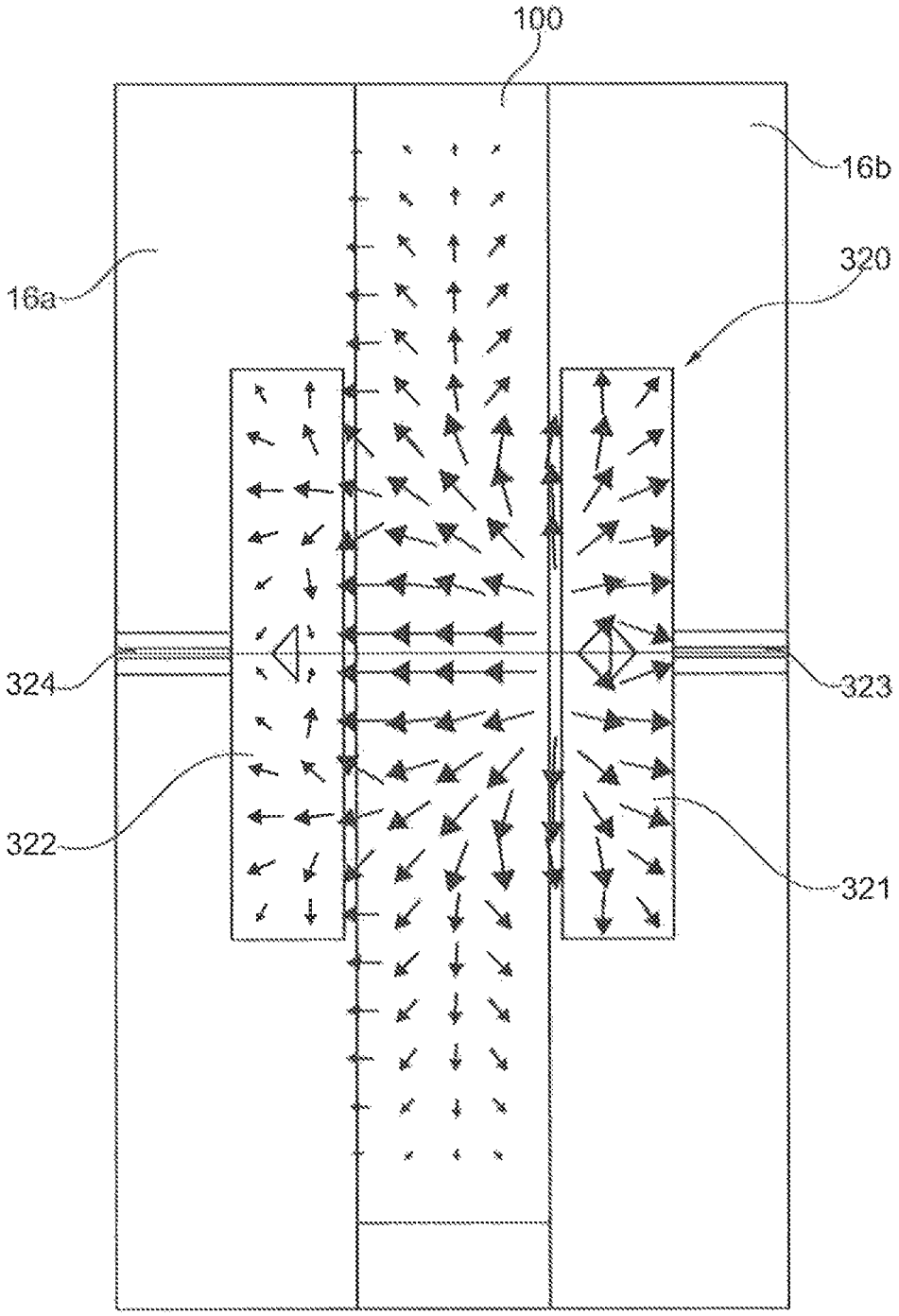
FIG. 9 shows a schematic representation of an embodiment of a suction belt conveyor with a capacitive measuring device with a field distribution.

FIG. 9 shows a plan view of a suction belt conveyor according to the invention with a rod guiding channel 100 which is delimited by the channel sides 16*a*, 16*b* and a capacitive measuring device 320.

The capacitive measuring device comprises two cutouts (cavities) 321, 322 that are provided opposite each other in the channel sides 16*a*, 16*b* and are filled with air or a dielectric. An electrode 323, 324 is inserted in each cutout. As can be seen in FIG. 9, the structure of the capacitive measuring device is similar to that of a plate capacitor.

The effective measuring window is determined by the field lines which are depicted by arrows in FIG. 9. The field lines also determine the actual effective measuring capacity. The remaining field lines are ascribable to stray capacitances.

All named features, including those taken from the drawings alone and individual features, which are disclosed in combination with other features, are considered alone and in combination as essential for the invention. Embodiments according to the invention can be fulfilled through individual features or a combination of several features. In the context of the invention, features which are designated with "in particular" or "preferably" are to be understood as optional features.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

REFERENCE LIST

1 sluice
2 predistributor
3 take-out roller
4 tank
5 steep-angle conveyor
6 bulking chute
7 pin roller
8 picker roller
9 apron
11 sieving device
12 pin roller
13 wall
14 funnel
16 rod guiding channel
16*a* channel side
16*b* channel side
16*c* cavity and cross-section of the rod guiding channel
17 suction belt
17*a* bottom run
18 vacuum chamber
19 trimmer
21 strip of cigarette paper
22 bobbin
23 print unit
24 garniture tape
26 format
27 tandem seam sealer
28 cigarette rod
29 Measuring unit
31 knife mechanism
32 double-length cigarettes
34 transfer apparatus
36 take-over drum
37 filter assembler
38 cutting drum
39 conveyor belt
41 conveyor belt
42 container
46 frame
48 drive device
50 controller
52 distance sensor
54 adjusting device
56 distance sensor
100 rod guiding channel
102 channel side
104 channel side
106 suction belt
108 conveying path
110 cover
112 fill height
160 suction belt conveyor
200 microwave measuring device
202, 203 resonator cavity
204, 205 opening
206, 207 coaxial resonator
208, 209 coaxial antenna
220 microwave measuring device
222, 223 resonator cavity
224, 225 opening
226, 227 rectangular resonator
228, 229 antenna
240 microwave measuring device
242, 243 resonator cavity
244, 245 opening
246, 247 rectangular resonator
248, 249 antenna
248*a*, 249*a* antenna cable
260 microwave measuring device
262 resonator cavity
264, 265 opening
266 slotted rectangular resonator
268, 269 antenna
268*a*, 269*a* antenna cable
270 antenna
272 collar
300, 302 absorbing element
304, 306 absorbing element
320 capacitive measuring device
321, 322 cutouts
323, 324 electrodes

What is claimed:

1. A suction belt conveyor for conveying material, comprising:

at least one rod guiding channel, which is open at a bottom and is delimited by two lateral channel sides and a suction belt along a conveying path; and at least one electromagnetic measuring device integrated in at least one of the lateral channel sides at least one position along the conveying path to determine properties of the material being conveyed, wherein the at least one electromagnetic measuring device comprises a microwave measuring device with at least one resonator cavity, and wherein the suction belt conveyor is configured for conveying tobacco in a rod-forming machine of the tobacco processing industry.

2. The suction belt conveyor according to claim 1, wherein the microwave measuring device comprises at least one measuring opening oriented toward the conveying path.

3. The suction belt conveyor according to claim 1, wherein the microwave measuring device comprises two coaxial resonators recessed in the two channel sides opposite each other.

4. The suction belt conveyor according to claim 1, wherein the at least one resonator cavity has a rectangular cross-section in each of the two lateral channel sides, each of the rectangular cross-sections being arranged flush with a respective one of the two lateral channel sides at least one rod guiding channel.

5. The suction belt conveyor according to claim 1, wherein the microwave measuring device comprises a reverse U-shaped slotted rectangular resonator that encloses three sides of the at least one rod guiding channel.

6. The suction belt conveyor according to claim 5, wherein the slotted rectangular resonator comprises three antennas, of which two antennas are arranged symmetrically to the lateral channel sides of the at least one rod guiding channel, and a third antenna is arranged in a plane of symmetry of the at least one resonator cavity above the at least one rod guiding channel.

7. The suction belt conveyor according to claim 6, wherein one of:

the two symmetrically arranged antennas are excited in-phase, and the third antenna serves as a decoupling antenna, or the third antenna is excited, and the two symmetrically arranged antennas serve as decoupling antennas.

8. The suction belt conveyor according to claim 1, further comprising at least one microwave-absorbing body recessed in at least one of the lateral channel sides at least one of upstream and downstream, with respect to a suction belt conveying direction, from the at least one resonator cavity.

9. The suction belt conveyor according to claim 1, wherein at least one of power and measuring electronics are arranged on the suction belt conveyor.

10. A rod-forming machine comprising the suction belt conveyor according to claim 1.

11. The rod-forming machine according to claim 10 being positionable in a tobacco rod-forming machine of the tobacco processing industry.

12. A method of operating an electromagnetic measuring device in the suction belt conveyor according to claim 1, wherein the electromagnetic measuring device comprises the microwave measuring device with the at least one resonator cavity, and the suction belt conveyor is arranged in the rod-forming machine in the tobacco industry, the method comprising:

holding tobacco material sprinkled from below onto the suction belt with suction air; and measuring material properties of the held tobacco material.

13. A method for measuring material properties of a material rod, comprising:

sprinkling material for the rod onto the suction belt of the suction belt conveyor according to claim 1 from below;

conveying the material via the suction belt along the conveying path through the at least one rod guiding channel of the suction belt conveyor; and measuring, in the at least one rod guiding channel and along the conveying path, material properties of the conveyed material on the suction belt with the at least one electromagnetic measuring device of the suction belt conveyor.

14. The method according to claim 13, wherein the material rod is a tobacco rod of the tobacco processing industry.

15. The method according to claim 13, wherein the microwave measuring device operates with a resonant method.

16. The method according to claim 15, wherein the resonant method is performed as a transmission method.

* * * * *